US010334353B2

(12) United States Patent
Shao et al.

(10) Patent No.: US 10,334,353 B2
(45) Date of Patent: Jun. 25, 2019

(54) LOUDSPEAKER MODULE AND ELECTRONIC PRODUCT

(71) Applicant: Goertek Inc., Weifang, Shandong Province (CN)

(72) Inventors: Minghui Shao, Weifang (CN); Jianbin Yang, Weifang (CN)

(73) Assignee: Goertek Inc., Weifang, Shandong Province (CN)

( * ) Notice: Subject to any disclaimer, the term of this patent is extended or adjusted under 35 U.S.C. 154(b) by 0 days.

(21) Appl. No.: 15/549,605

(22) PCT Filed: Nov. 24, 2015

(86) PCT No.: PCT/CN2015/095419
§ 371 (c)(1),
(2) Date: Aug. 8, 2017

(87) PCT Pub. No.: WO2016/145906
PCT Pub. Date: Sep. 22, 2016

(65) Prior Publication Data

US 2018/0035199 A1 Feb. 1, 2018

(30) Foreign Application Priority Data

Mar. 18, 2015 (CN) ..... 2015 1 0121037

(51) Int. Cl.
*H04R 1/20* (2006.01)
*H04R 1/28* (2006.01)
*H04R 9/06* (2006.01)

(52) U.S. Cl.
CPC ..... *H04R 1/2803* (2013.01); *H04R 1/20* (2013.01); *H04R 9/06* (2013.01); *H04R 2499/11* (2013.01); *H04R 2499/15* (2013.01)

(58) Field of Classification Search
CPC .. H04R 1/2803; H04R 1/2826; H04R 1/2846; H04R 2499/11; H04R 2499/15
See application file for complete search history.

(56) References Cited

U.S. PATENT DOCUMENTS 5,790,679 A * 8/1998 Hawker ..... H04M 1/0202 379/388.02
8,259,985 B2 9/2012 Yang et al.
(Continued)

FOREIGN PATENT DOCUMENTS

CN 101212838 A 7/2008
CN 101500185 A 8/2009
(Continued)

OTHER PUBLICATIONS

International Search Report dated Jan. 27, 2016 from corresponding International Application No. PCT/CN2015/095419, 5 pages.
(Continued)

*Primary Examiner* — Sunita Joshi
(74) *Attorney, Agent, or Firm* — Ohlandt, Greeley, Ruggiero & Perle, L.L.P.

(57) ABSTRACT

A loudspeaker module comprises a housing and a loudspeaker unit. The housing is provided with an inner cavity for receiving and fixing the loudspeaker unit. A vibrating diaphragm of the loudspeaker unit partitions the inner cavity into a front sound cavity and a rear sound cavity. The front sound cavity is in communication with at least two sound uttering holes, and the at least two sound uttering holes are distributed on different sides of the housing. The electronic product comprises the loudspeaker module. By means of the technical solution of the present disclosure, the sound uttering holes are provided individually on different sides of a housing of a loudspeaker module. Due to the design of holes opened on at least two sides around the front cavity structure, the loudspeaker module having a side sound uttering
(Continued)

structure reduces pipelines introduced during the implementation of the side sound uttering solution, and can achieve the effect of equivalently increasing the length of the sound uttering holes by increasing the number of the sound uttering holes, thereby extending the high-frequency characteristic of the electronic product having the loudspeaker module.

16 Claims, 3 Drawing Sheets

(56) References Cited

U.S. PATENT DOCUMENTS

| | | | | |
|---|---|---|---|---|
| 2007/0242848 | A1 | 10/2007 | Yang | |
| 2008/0199038 | A1 | 8/2008 | Holmes et al. | |
| 2009/0190788 | A1 | 7/2009 | Yang et al. | |
| 2014/0029779 | A1* | 1/2014 | Yamauchi | H04N 5/642 381/333 |
| 2014/0064522 | A1 | 3/2014 | Litovsky et al. | |
| 2014/0241562 | A1* | 8/2014 | Monahan | H04R 1/1016 381/380 |
| 2017/0134848 | A1 | 5/2017 | Shao et al. | |

FOREIGN PATENT DOCUMENTS

| | | | |
|---|---|---|---|
| CN | 202841515 | U | 3/2013 |
| CN | 103957487 | A | 7/2014 |
| CN | 203708469 | U | 7/2014 |
| CN | 203851284 | U | 9/2014 |
| CN | 104159179 | A | 11/2014 |
| CN | 104768088 | A | 7/2015 |
| CN | 204616002 | U | 9/2015 |

OTHER PUBLICATIONS

Written Opinion dated Jan. 27, 2016 from corresponding International Application No. PCT/CN2015/095419, 9 pages.
Chinese First Office Action dated Aug. 14, 2017 from corresponding Chinese Patent Application No. 2015101271037.4, 15 pages.
Chinese Second Office Action dated Apr. 3, 2018 from corresponding Chinese Patent Application No. 2015101271037.4, 7 pages.
Chinese Third Office Action dated Sep. 29, 2018 from corresponding Chinese Patent Application No. 201510121037.4, 7 pages.

* cited by examiner

LOUDSPEAKER MODULE AND ELECTRONIC PRODUCT

BACKGROUND OF THE DISCLOSURE

Field of the Disclosure

The present disclosure relates to the technical field of electroacoustic products, and particularly relates to a loudspeaker module and electronic product having the same.

Description of the Related Art

Currently, the loudspeaker modules of many applications including Pads, notebook computers and mobile phones all use the side sound uttering solution, in which the sound holes are usually concentrated on one side of the loudspeaker module, and corresponding sound uttering holes of the system end are opened on one of the four sides of the housing.

Although the side sound uttering solution can well solve the problem of the appearance of the products, and avoid the defect that the radiation surface of the loudspeaker and the screen are on the same plane, the side sound uttering solution introduces the front cavity and pipelines during its implementation, which affects the high-frequency characteristic of the products.

SUMMARY OF THE DISCLOSURE

The present disclosure provides a loudspeaker module and an electronic product having the same, so as to improve the high-frequency characteristic of the loudspeaker module, thereby extending the high-frequency characteristic of the electronic product having the loudspeaker module.

In order to achieve the above objective, the technical solutions of the present disclosure are implemented as follows:

In one aspect, the embodiments of the present disclosure provide a loudspeaker module, comprising a housing and a loudspeaker unit; wherein the housing is provided with an inner cavity for receiving and fixing the loudspeaker unit, and a vibrating diaphragm of the loudspeaker unit partitions the inner cavity into a front sound cavity and a rear sound cavity; and wherein the front sound cavity is in communication with at least two sound uttering holes, and the at least two sound uttering holes are distributed on different sides of the housing.

Preferably, the at least two sound uttering holes are distributed on two adjacent sides of the housing.

Preferably, the housing comprises an upper module housing and a lower module housing, and the at least two sound uttering holes are provided completely on the upper module housing, or provided completely on the lower module housing, or provided individually on the upper module housing and the lower module housing.

Preferably, the housing comprises an upper module housing and a lower module housing, and the at least two sound uttering holes are formed by the upper module housing and the lower module housing in cooperation.

Preferably, the housing comprises an upper module housing and a lower module housing, and part of the at least two sound uttering holes are provided on the upper module housing, or provided on the lower module housing, or provided individually on the upper module housing and the lower module housing, while the other part of the sound uttering holes are formed by the upper module housing and the lower module housing in cooperation.

Preferably, the housing comprises an upper module housing, a lower module housing and a middle module housing, and the at least two sound uttering holes are formed by the upper module housing and the middle module housing in cooperation.

Preferably, the housing comprises an upper module housing, a lower module housing and a middle module housing, and the at least two sound uttering holes are provided completely on the upper module housing, or provided completely on the middle module housing, or provided individually on the upper module housing and the middle module housing.

Preferably, the housing comprises an upper module housing, a lower module housing and a middle module housing, and part of the at least two sound uttering holes are provided on the upper module housing, or provided on the middle module housing, or provided individually on the upper module housing and the middle module housing, while the other part of the sound uttering holes are formed by the upper module housing and the middle module housing in cooperation.

In the technical solution, sound uttering holes are provided individually on different sides of a housing of a loudspeaker module. Due to the design of holes opened on at least two sides around the front cavity structure, the loudspeaker module having a side sound uttering structure reduces pipelines introduced during the implementation of the side sound uttering solution, and can achieve the effect of equivalently increasing the length of the sound uttering holes by increasing the number of the sound uttering holes, thereby extending the high-frequency characteristic of the loudspeaker module.

In another aspect, the embodiments of the present disclosure provide an electronic product, comprising a loudspeaker module provided by the above technical solutions; wherein the loudspeaker module is provided at a corner of the electronic product, and different housing sidewalls of the electronic product are provided individually with several sound transmission openings, in correspondence with different sides of the loudspeaker module that are provided with the sound uttering holes.

In this technical solution, the loudspeaker module is assembled to a corner of the electronic product, and the housing sidewalls of the electronic product are provided individually with the sound transmission openings, in correspondence with the different sides of the loudspeaker module that are provided with the sound uttering holes, so that sounds are uttered from the different housing sidewalls of the electronic product smoothly.

BRIEF DESCRIPTION OF DRAWINGS

The drawings are only for the purpose of illustrating the preferable embodiments, and are not considered as limitation to the present disclosure. In the drawings.

wherein, 1: housing; 11: upper module housing; 12: middle module housing; 13: lower module housing; 2: loudspeaker unit; 3: sound uttering hole; 4: front sound cavity; 5: loudspeaker module; 6: housing sidewalls; and 7: sound transmission openings.

DETAILED DESCRIPTION OF THE DISCLOSURE

For a loudspeaker module having a front sound cavity, the high-frequency characteristic of the product is influenced by the volume of the front sound cavity and the size of the sound uttering hole (cross-sectional area and length). The high-frequency effect is better as the volume of the front sound cavity is decreased. If the volume of the front sound cavity is given, the high-frequency characteristic of the product is better as either the cross-sectional area or the length of the sound uttering hole is increased.

It is very difficult for the volume of the front sound cavity to be very small under the influence of the vibration space, and it is also very difficult for the height of the sound pipeline of the front sound cavity to be enlarged due to the restriction by the entire thickness of the product.

In view of the above circumstances, in order to further extend the high-frequency characteristic of the product, the present disclosure makes a design of holes opened on at least two sides around a front cavity structure, and produces the effect of equivalently increasing the length of sound uttering holes by increasing the number of the sound uttering holes, thereby achieving the objective of extending the high-frequency characteristic of the product.

In order to make the objects, the technical solutions and the advantages of the present disclosure clearer, the embodiments of the present disclosure will be described below in further detail in conjunction with the drawings.

Figure 1:
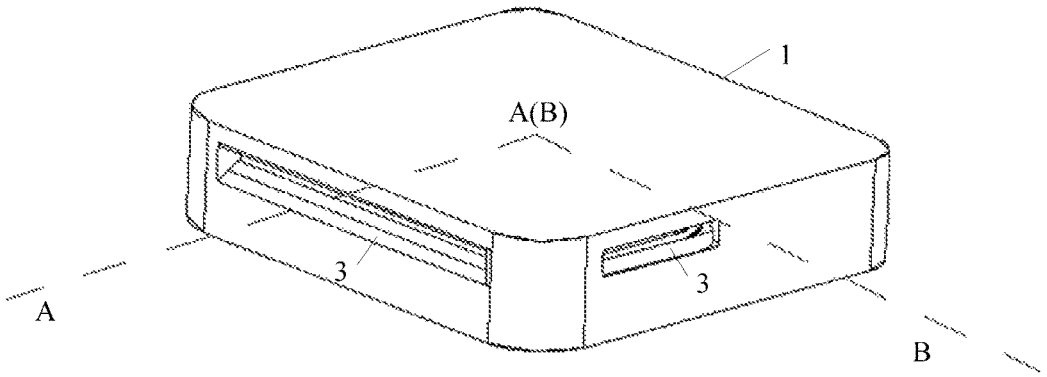
FIG. 1 is a schematic outline view of a loudspeaker module provided by an embodiment of the present disclosure.
Figure 2:
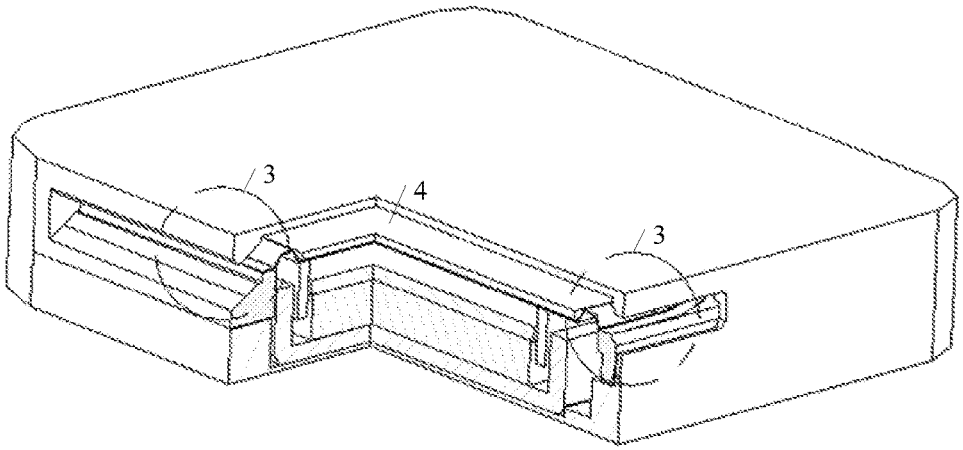
FIG. 2 is a sectional view along the section line AA-BB of a loudspeaker module provided by an embodiment of the present disclosure.
Figure 3:
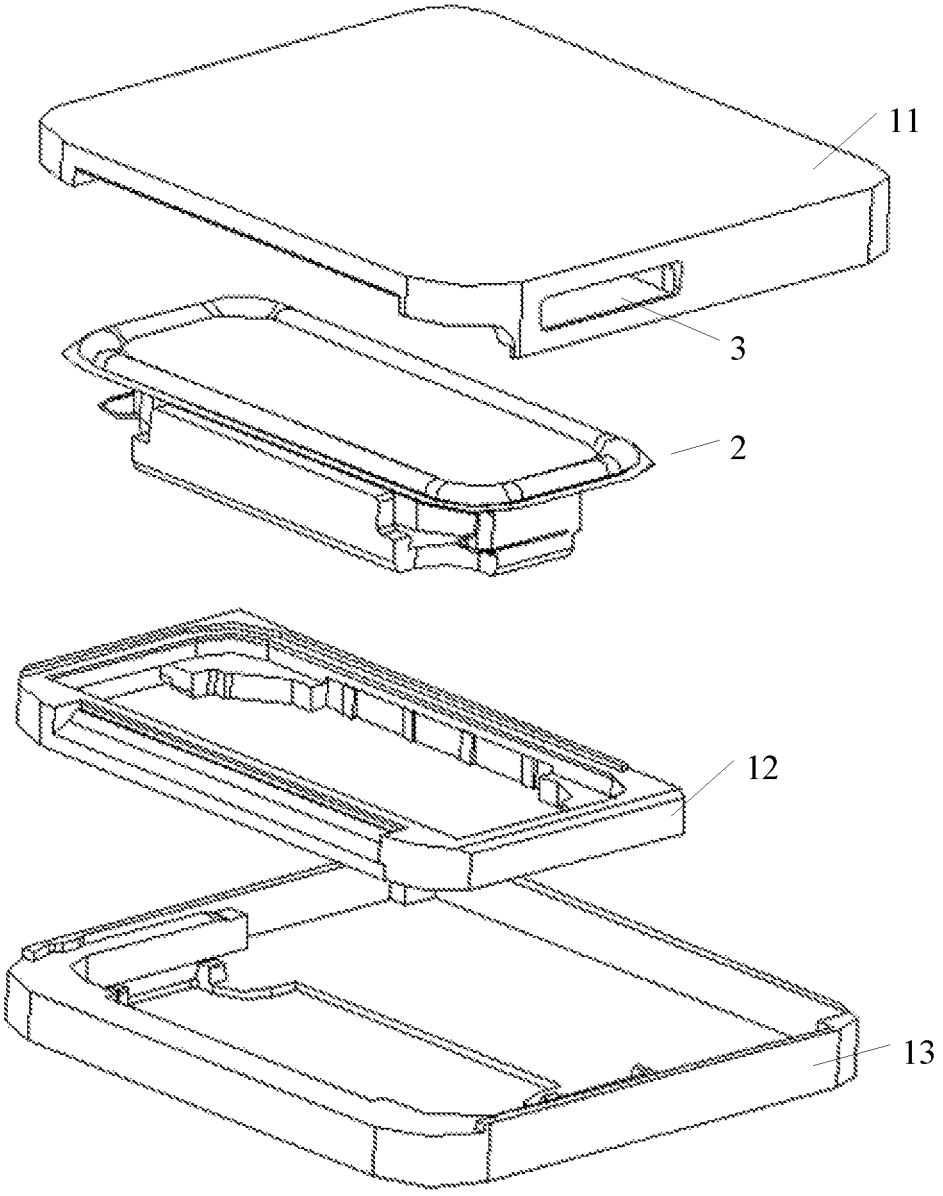
FIG. 3 is a schematic composition view of a loudspeaker module provided by an embodiment of the present disclosure.

As illustrated by FIGS. 1 to 3 together, a loudspeaker module provided by an embodiment of the present disclosure comprises a housing 1 and a loudspeaker unit 2; wherein the housing 1 is provided with an inner cavity for receiving and fixing the loudspeaker unit 2, and a vibrating diaphragm of the loudspeaker unit 2 partitions the inner cavity into a front sound cavity and a rear sound cavity.

In that, the cavity between the vibrating diaphragm of the loudspeaker unit 2 and sound uttering holes 3 of the module is the front sound cavity, which is in communication with the sound uttering holes 3, and the other cavity that is corresponding to the front sound cavity is the rear sound cavity, which is sealed and in communication with the outside only through damping holes to ensure that the air pressure in the rear sound cavity is the same as that in the front sound cavity. Preferably, the rear sound cavity is provided therein with materials such as sound-absorbing cotton to adjust the acoustic performance of the loudspeaker module.

To be noted, the arrangement scheme of the sound uttering holes in the present disclosure is particularly suitable for the loudspeaker module having a side sound uttering structure.

In this embodiment, the front sound cavity is in communication with at least two sound uttering holes 3 distributed on different sides of the housing 1, such as different sides of the hexahedron in FIG. 1. It should be appreciated that the different sides in the technical solution may be those corresponding to a prismoid, a cylinder or any other regular or irregular polyhedrons.

Preferably, the at least two sound uttering holes 3 are distributed on two adjacent sides of the housing 1. FIG. 1 exemplarily illustrates that the two sound uttering holes 3 are distributed on two adjacent sides of the housing 1. It is obvious that any side in this embodiment is not limited to being provided with only one sound uttering hole.

The size of the sound uttering holes and the volume of the front sound cavity influence the high cut-off frequency. The high frequency effect is better as the size of the sound uttering holes (the cross-sectional area and length) is increased or the volume of the front sound cavity is decreased. Thus in this embodiment, the sound uttering holes are provided on different sides of the housing of the loudspeaker module, and due to the design of holes opened on at least two sides around the front cavity structure, the loudspeaker module having a side sound uttering structure reduces pipelines introduced during the implementation of the side sound uttering solution, and can achieve the effect of equivalently increasing the length of the sound uttering holes by increasing the number of the sound uttering holes, thereby extending the high-frequency characteristic of the loudspeaker module.

In one embodiment of the present disclosure, the housing comprises an upper module housing and a lower module housing, which cooperate to form the inner cavity for receiving the loudspeaker unit. In the actual design, the distribution and formation manner of the sound uttering holes may be specifically designed according to the whole design requirement on the loudspeaker module, and are not limited herein. For example, the at least two sound uttering holes are provided completely on the upper module housing, or provided completely on the lower module housing, or provided individually on the upper module housing and the lower module housing. Alternatively, the at least two sound uttering holes are formed by the upper module housing and the lower module housing in cooperation. Alternatively, part of the sound uttering holes are provided on the upper module housing, or provided on the lower module housing, or provided individually on the upper module housing and the lower module housing, while the other part of the sound uttering holes are formed by the upper module housing and the lower module housing in cooperation.

To be noted, the shape or construction manner of the housing of the loudspeaker module is not specifically defined in this embodiment, provided that the housing can meet the design requirement. For example, the housing in this embodiment may also be composed of an upper module housing, a middle module housing and a lower module housing, and the shape of the housing may be a hexahedron or any other regular or irregular polyhedrons.

As illustrated by FIGS. 2 and 3 together, in order to facilitate the assembly of the loudspeaker module, the housing in this embodiment comprises an upper module housing 11, a lower module housing 13 and a middle module housing 12, and the space surrounded by the upper module housing 11, the lower module housing 13 and the middle module housing 12 receives the loudspeaker unit 2.

In that, at least two sound uttering holes are formed by the upper module housing and the middle module housing in cooperation. Alternatively, the at least two sound uttering holes are provided completely on the upper module housing, or provided completely on the middle module housing, or provided individually on the upper module housing and the middle module housing. Alternatively, part of the sound uttering holes are provided on the upper module housing, or provided on the middle module housing, or provided individually on the upper module housing and the middle module housing, while the other part of the sound uttering holes are formed by the upper module housing and the middle module housing in cooperation.

In the embodiment as illustrated by FIGS. 2 and 3 together, the distribution and formation manner of the two sound uttering holes 3 are exemplarily shown, wherein one of the sound uttering holes 3 is provided on the upper module housing 13 of the housing 1, and the other is formed by the upper module housing 11 and the middle module housing 12 in cooperation.

To be noted, the two sound uttering holes 3 in this embodiment may also be provided completely on the upper module housing 11 or the middle module housing 12, or one is provided on the upper module housing 11 and the other is provided on the middle module housing 12. Alternatively, the two sound uttering holes 3 in this embodiment may be both formed by the upper module housing 11 and the middle module housing 12 in cooperation.

Figure 4:
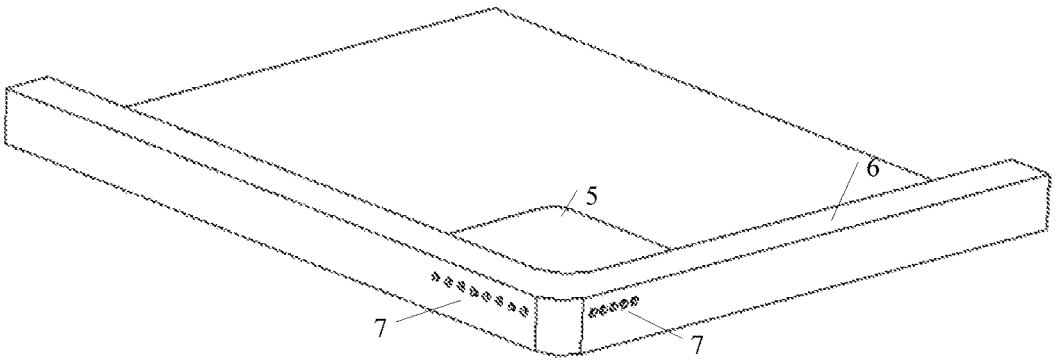
FIG. 4 is a schematic outline view of an electronic product assembled with a loudspeaker module provided by an embodiment of the present disclosure.
Figure 5:
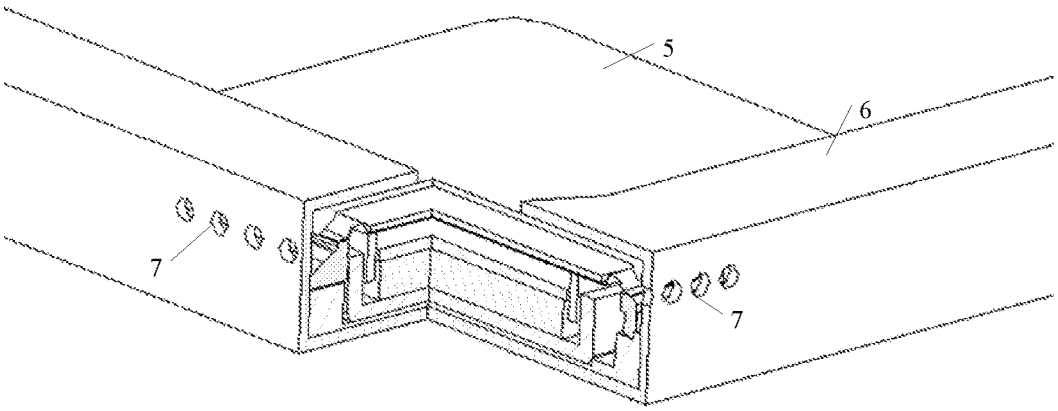
FIG. 5 is a schematic sectional view of an electronic product assembled with a loudspeaker module provided by an embodiment of the present disclosure.

The electronic product provided by another embodiment of the present disclosure is illustrated by FIGS. 4 and 5 together, comprising the loudspeaker module 5 of the above embodiments, which is provided at a corner of the electronic product. Different housing sidewalls 6 of the electronic product are provided individually with several sound transmission openings 7, in correspondence with different sides of the loudspeaker module that are provided with the sound uttering holes.

In a preferred solution of this embodiment, the at least two sound uttering holes of the loudspeaker module 5 are distributed on two adjacent sides of the housing, and correspondingly, two adjacent housing sidewalls 6 of the electronic product are provided individually with several sound transmission openings 7, in correspondence with the two adjacent sides of the loudspeaker module 5 that are provided with the sound uttering holes.

In this embodiment, the loudspeaker module is assembled to a corner of the electronic product, and the housing sidewalls of the electronic product are provided individually with the sound transmission openings, in correspondence with the different sides of the loudspeaker module that are provided with the sound uttering holes, so that sounds are uttered from the different housing sidewalls of the electronic product smoothly.

In conclusion, the embodiments of the present disclosure provide a loudspeaker module and an electronic product having the same, wherein sound uttering holes are provided individually on different sides of a housing of the loudspeaker module. Due to the design of holes opened on at least two sides around the front cavity structure, the loudspeaker module having a side sound uttering structure reduces pipelines introduced during the implementation of the side sound uttering solution, and can achieve the effect of equivalently increasing the length of the sound uttering holes by increasing the number of the sound uttering holes, thereby extending the high-frequency characteristic of the electronic product having the loudspeaker module.

The above descriptions are merely preferable embodiments of the present disclosure, and are not limiting the protection scope of the present disclosure. Any modifications, equivalent substitutions or improvements that are made within the spirit and principle of the present disclosure are all included in the protection scope of the present disclosure.

What is claimed is:

1. A loudspeaker module comprising a housing, a loudspeaker unit and a side sound uttering structure, the housing being provided with an inner cavity for receiving and fixing the loudspeaker unit and a vibrating diaphragm of the loudspeaker unit partitions the inner cavity into a front sound cavity and a rear sound cavity, wherein the front sound cavity is in communication with at least two sound uttering holes, and the at least two sound uttering holes are distributed on different sides of the housing, and wherein the rear sound cavity is sealed and in communication with the outside the loudspeaker module only through damping holes.

2. The loudspeaker module according to claim 1, wherein the at least two sound uttering holes are distributed on two adjacent sides of the housing.

3. The loudspeaker module according to claim 1, wherein the housing comprises an upper module housing and a lower module housing, and the at least two sound uttering holes are provided completely on the upper module housing, or provided completely on the lower module housing, or provided individually on the upper module housing and the lower module housing.

4. The loudspeaker module according to claim 1, wherein the housing comprises an upper module housing and a lower module housing, and the at least two sound uttering holes are formed by the upper module housing and the lower module housing in cooperation.

5. The loudspeaker module according to claim 1, wherein the housing comprises an upper module housing and a lower module housing, and part of the at least two sound uttering holes are provided on the upper module housing, or provided on the lower module housing, or provided individually on the upper module housing and the lower module housing, while the other part of the sound uttering holes is formed by the upper module housing and the lower module housing in cooperation.

6. The loudspeaker module according to claim 1, wherein the housing comprises an upper module housing, a lower module housing and a middle module housing, and the at least two sound uttering holes are formed by the upper module housing and the middle module housing in cooperation.

7. The loudspeaker module according to claim 1, wherein the housing comprises an upper module housing, a lower module housing and a middle module housing, and the at least two sound uttering holes are provided completely on the upper module housing, or provided completely on the middle module housing, or provided individually on the upper module housing and the middle module housing.

8. The loudspeaker module according to claim 1, wherein the housing comprises an upper module housing, a lower module housing and a middle module housing, and part of the at least two sound uttering holes are provided on the upper module housing, or provided on the middle module housing, or provided individually on the upper module housing and the middle module housing, while the other part of the sound uttering holes are formed by the upper module housing and the middle module housing in cooperation.

9. An electronic product comprising a loudspeaker module, the loudspeaker module is provided at a corner of the electronic product, and the loudspeaker module comprising a housing, a loudspeaker unit and a side sound uttering structure, the housing having different sides and being provided with an inner cavity for receiving and fixing the loudspeaker unit and a vibrating diaphragm of the loudspeaker unit partitions the inner cavity into a front sound cavity and a rear sound cavity, wherein the front sound cavity is in communication with at least two sound uttering holes, and the at least two sound uttering holes are distributed on the different sides of the housing, wherein the rear sound cavity is sealed and in communication with the outside of the electronic product only through damping holes, and the electronic product has different housing sidewalls that are provided individually with several sound transmission openings, in correspondence with different sides of the loudspeaker module that are provided with the sound uttering holes.

10. The electronic product according to claim 9, wherein the at least two sound uttering holes are distributed on two adjacent sides of the housing.

11. The electronic product according to claim 9, wherein the housing comprises an upper module housing and a lower module housing, and wherein the at least two sound uttering holes are provided at a location selected from the group consisting of: completely on the upper module housing, completely on the lower module housing, and individually on the upper module housing and the lower module housing.

12. The electronic product according to claim 9, wherein the housing comprises an upper module housing and a lower module housing, and wherein the at least two sound uttering holes are formed by the upper module housing and the lower module housing in cooperation.

13. The electronic product according to claim 9, wherein the housing comprises an upper module housing and a lower module housing, and wherein part of the at least two sound uttering holes are provided at a location selected from the group consisting of: on the upper module housing, on the lower module housing, and individually on the upper module housing and the lower module housing, while the other part of the sound uttering holes are formed by the upper module housing and the lower module housing in cooperation.

14. The electronic product according to claim 9, wherein the housing comprises an upper module housing, a lower module housing and a middle module housing, and wherein the at least two sound uttering holes are formed by the upper module housing and the middle module housing in cooperation.

15. The electronic product according to claim 9, wherein the housing comprises an upper module housing, a lower module housing and a middle module housing, and wherein the at least two sound uttering holes are provided at a location selected from the group consisting of: completely on the upper module housing, completely on the middle module housing, and individually on the upper module housing and the middle module housing.

16. The electronic product according to claim 9, wherein the housing comprises an upper module housing, a lower module housing and a middle module housing, and wherein part of the at least two sound uttering holes are provided at a location selected from the group consisting of: on the upper module housing, on the middle module housing, and individually on the upper module housing and the middle module housing, while the other part of the sound uttering holes are formed by the upper module housing and the middle module housing in cooperation.

* * * * *